US006729242B2

(12) United States Patent
Kerber

(10) Patent No.: US 6,729,242 B2
(45) Date of Patent: May 4, 2004

(54) ADJUSTABLE RETAIL STORE CHECKOUT STAND, AND ARRANGEMENTS

(76) Inventor: Philip S. Kerber, 2688 30th Ave., Osceola, WI (US) 54020

( * ) Notice: Subject to any disclaimer, the term of this patent is extended or adjusted under 35 U.S.C. 154(b) by 94 days.

(21) Appl. No.: 10/140,221

(22) Filed: May 6, 2002

(65) Prior Publication Data

US 2003/0205177 A1 Nov. 6, 2003

(51) Int. Cl.[7] ..... A47B 23/00
(52) U.S. Cl. ..... 108/42; 108/147.17
(58) Field of Search ..... 108/42, 147.11, 108/147.17; 186/59, 65; 248/125.1, 125.2, 161, 162.1, 157

(56) References Cited

U.S. PATENT DOCUMENTS

| | | | | |
|---|---|---|---|---|
| 2,418,067 A | | 3/1947 | Carpemter, Sr. | |
| 3,651,890 A | * | 3/1972 | Potrafke | 186/68 |
| 3,700,074 A | | 10/1972 | Shoffner | |
| 3,730,469 A | | 5/1973 | Shields | |
| 4,401,189 A | | 8/1983 | Majewski | |
| 4,618,032 A | | 10/1986 | Woolf | |
| 4,619,427 A | | 10/1986 | Leymann | |
| 4,687,166 A | | 8/1987 | Poehler | |
| 4,789,048 A | | 12/1988 | Cramer et al. | |
| 4,838,383 A | | 6/1989 | Saito et al. | |
| 4,953,664 A | | 9/1990 | Vrooman et al. | |
| 4,963,721 A | | 10/1990 | Kohno et al. | |
| 5,019,694 A | | 5/1991 | Collins, Jr. | |
| 5,039,051 A | | 8/1991 | Umebara et al. | |
| 5,082,037 A | | 1/1992 | Hammons et al. | |
| 5,183,135 A | | 2/1993 | Kurimoto et al. | |
| 5,199,763 A | * | 4/1993 | Wilder et al. | 297/338 |
| 5,207,294 A | | 5/1993 | Kurimoto et al. | |
| 5,606,917 A | * | 3/1997 | Cauffiel | 108/42 |
| 5,615,620 A | * | 4/1997 | Owen | 108/45 |
| 5,931,102 A | * | 8/1999 | Grahl | 108/42 |
| 6,116,163 A | * | 9/2000 | Mitchell | 108/42 |
| 6,240,856 B1 | * | 6/2001 | Paskey et al. | 108/146 |
| 6,336,412 B2 | * | 1/2002 | Heimbrock et al. | 108/42 |
| 6,439,134 B1 | * | 8/2002 | Ryburg | 108/42 |
| 6,470,809 B1 | * | 10/2002 | Herbert | 108/44 |
| 6,572,208 B2 | * | 6/2003 | Albaizar et al. | 312/314 |

FOREIGN PATENT DOCUMENTS

| | | | |
|---|---|---|---|
| JP | 220017 | * | 8/1993 |

OTHER PUBLICATIONS

Pending U.S. patent application Ser. No. 10/138,745, "Retail Store Checkout Assembly, Point–Of–Sale Equipment Stand And Arrangements" (Kerber), filed May 3, 2002.

* cited by examiner

*Primary Examiner*—Jose V. Chen
(74) *Attorney, Agent, or Firm*—Merchant & Gould P.C.

(57) ABSTRACT

A checkout console for use with a counter-top or conveyor belt point-of-sale checkout stand. The checkout console can support a cash drawer, printer, keyboard, and other such peripheral equipment, and can be mounted so that the top shelf is above a bar code scanner. By positioning the console between the cashier and the customer, twisting and turning be the cashier is greatly reduced. The console, once mounted, is vertically adjustable on demand.

20 Claims, 5 Drawing Sheets

ADJUSTABLE RETAIL STORE CHECKOUT STAND, AND ARRANGEMENTS

FIELD OF THE INVENTION

The present invention relates to retail store checkout stands, and more specifically, to checkout stands having an auxiliary structure that allows face to face contact between the cashier and the customer and that also allows vertical adjustment of the structure.

BACKGROUND OF THE INVENTION

Anyone who has been in a retail store is familiar with the checkout stand; the checkout stand is where one pays for the selected items. Checkout stands, also commonly referred to as checkstands, can be arranged in a broad variety of configurations. The checkout stand may include one belt, two belts, three belts, or merely have a stationary surface, generally supported by a counter or cabinet. A bar code scanner is typically recessed into the counter or cabinet. Also included at the checkout stand are the register, cash drawer, a keyboard, a credit card machine (often referred to as a credit card swipe and pin pad machine), a receipt printer, monitor or display, telephone, and other such accessory equipment. The register, cash drawer, and other equipment is typically positioned on a cabinet often referred to as a cashstand, which is positioned to the left or right of the cashier, at a right angle, as the cashier is looking at the customer.

The goal within the industry has been to arrange the checkout stand in a manner that is convenient for both the customer and the cashier. The layout of the checkout stand and the configuration of the equipment impact both the customer and cashier. Because the checkout stand is a highly visible feature of the retail shopping experience for the customer, providing a well arranged and configured checkout stand is important. The layout of the checkout stand can enhance or deter from the customer's experience, which can affect whether or not that customer shops at that store again. For example, a cluttered checkout stand, with cables and electrical cords exposed, is messy and uninviting. A checkout stand not well organized is also viewed as messy and as inefficient.

For the cashier, standing at the checkout stand is a daily occurrence, with repetitive motions. When the cash drawer and register are located at a cashstand, the cashier has to twist or rotate 90 degrees from the scanner to the register and back to the customer, losing both eye contact with the customer as well as their view of the cash drawer, which may be inadvertently left open as they again turn to face the customer.

With more and more equipment being added to checkout stands, the space available for positioning the equipment is at a premium. One solution has been to include a podium, console, or other auxiliary structure positioned away from the cashstand, typically positioned between the cashier and the customer in the vicinity of the bar code scanner. In some designs, these consoles are built onto a counter surface; in other designs, the consoles are bolted or otherwise attached to the counter. This console generally supports some of the equipment integral to the checkout process, for example, such as the keyboard, a credit card swipe and pin pad machine, and/or a display monitor. A separately mounted horizontal pad, often called a checkwrite, can be used by the customer for writing checks or for signing credit card receipts. The cash drawer and receipt printer have, to date, remained to the left or right of the cashier at the cashstand.

The arrangement of having the console above the scanning area and above the scanner is generally a superior arrangement. To maximize the ease of the checkout transaction, it is desired to keep the height of the console as low as possible, preferably with near zero clearance between the tip of the scanner and the bottom of the console. However, lowering the height of the console to improve customer-cashier view can hinder the minimum clearance needed above the scanner, for example, for removal of the scanner for maintenance and service.

What is desired is a compact console arrangement that allows access to available equipment, such as the scanner, and provides a configuration that is friendly and convenient to both the customer and cashier. What is also desired is a console arrangement that minimizes cashier fatigue and injury potential due to twisting stresses, that provides cash drawer security, and that speeds the checkout transaction.

SUMMARY OF THE INVENTION

The present invention is directed to a console for use with a store checkout stand. The console of the present invention reduces twisting and turning of the cashier by providing the cash drawer in a location between the cashier and the customer. The console also incorporates an elevation system to facilitate raising and lowering the console top, on demand, for example, to gain access to equipment, such as the bar code scanner, positioned below the console top.

The console can be incorporated into any type of checkout stands, such as with conveyor belt systems or with a checkout stand that simply uses a counter. The console can be mounted onto a counter or cabinet, such as on a siderail or sidewall, on a vertical or a horizontal surface.

In one particular aspect, the console comprises a stand support structure and a top support structure, the stand support structure having a leg, a mounting portion fixed to and movable in respect to the leg, and a biasing element connected to the leg and to the mounting portion. The top support structure is attached to the stand support structure and has a first portion, and a second portion, the second portion movably attached to the first portion. The mounting portion of the stand support structure can be a bracket, configured for mounting to a vertical surface such as a counter sidewall. Alternately, the bracket can be configured for mounting to a horizontal surface, such as a floor. The biasing element can be a spring, such as a coil or coiled spring. The first portion can have a top fixedly attached thereto, and the second portion, which is movable in respect to the first portion, is fixedly attached to a surface, such as a vertical counter sidewall. The first portion of the top support structure can have at least one slot therein, and the second portion has an element for engaging the slot. In most embodiments, the first portion will have a slot at each end. In an alternate embodiment, the second portion can have at least one slot therein, and the first portion has an element for engaging the slot.

In another particular aspect, the leg, which, by means of a saddle, attaches to the first portion of the top support structure. It has been found that the weight of the console plus the cash drawer, its contents, and any other equipment, create considerable torque among the top support structure and the stand support structure. The saddle is constructed to transfer force from the console top to the leg and mounting portion.

Preferably, the console is mounted between the cashier and the customer, above or in close proximity to the bar code scanner. In a preferred embodiment, the console includes a volume for receiving a cash drawer. By positioning the cash drawer in a location in front of the cashier when the cashier is facing the customer, twisting and turning of the cashier is minimized, and the drawer is placed in front of the cashier, rather than at a side location where security can be an issue. Further, by positioning the cash drawer in front of the cashier, the efficiency of the checkout transaction is increased.

Other console constructions, checkout stands incorporating the console, and methods of raising and lowering the top of a console, are disclosed.

DETAILED DESCRIPTION OF THE PREFERRED EMBODIMENT

Figure 2:
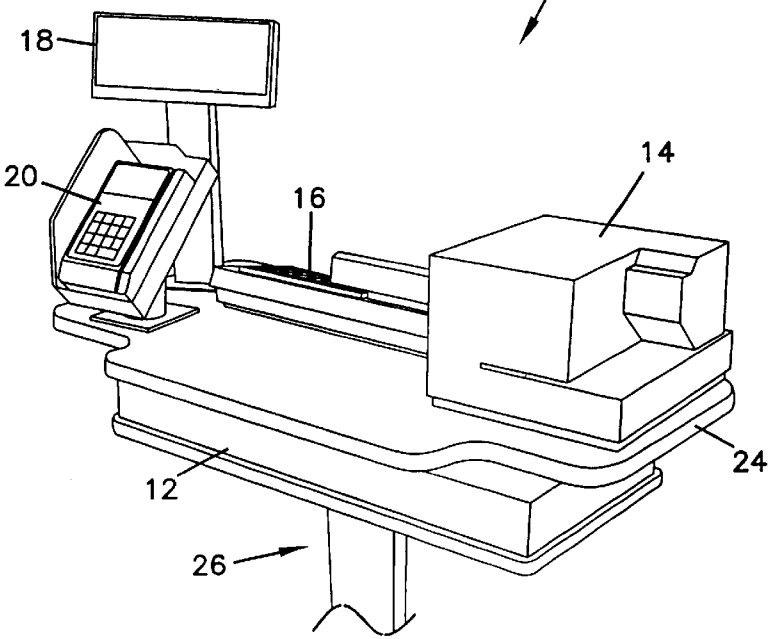
FIG. 2 is a bottom perspective view of the console of FIG. 1.
Figure 1:
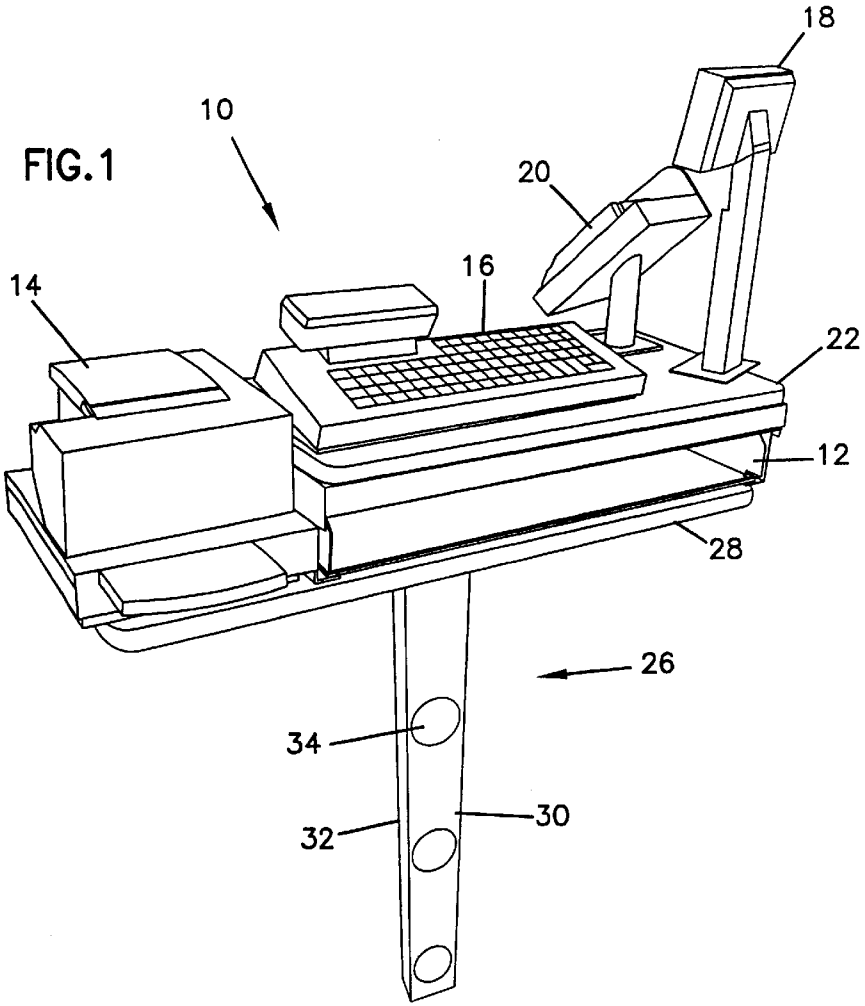
FIG. 1 is a top perspective view of a checkout console according to the present invention.

The preferred embodiment of the invention is now described in detail with reference to the drawings, wherein like reference numerals represent like parts and assemblies throughout the several views.

Referring to FIGS. 1–4, a checkout console 10 is shown. Console 10 can be incorporated with any checkout stand or checkstand, such as a counter system or a conveyor belt system. Console 10 includes a top structure 12 supported by a stand support structure 14 and a top support structure 16. Top 12 is generally removable from top support structure 16, which includes a fixed support portion 18 and a bracket portion 24, which will be described in detail below.

In the embodiment shown, top 12 is a generally rectangular, planar structure, although other configurations of top 12 can be used. Top 12 may alternately be referred to as a shelf or topper. When installed at a checkout stand, peripheral equipment such as a monitor or digital display, a credit card reader, a keyboard, and a check-writing area may be present on top 12. It is understood that the peripheral equipment can be configured in any manner, and that additional or alternate types of peripheral equipment, such as a telephone, may be positioned on top 12 of checkout console 10. Top 12 is shown as having various apertures present therein, for passing various cables and wires, such as from the peripheral equipment, therethrough. Knock-outs can be present to allow for adding apertures.

Top 12 is supported by the top support structure 16, which is in turn supported by stand support structure 14. Stand support structure 14 positions top 12 at the desired height. Stand support structure 14 provides a mechanism to bolt, secure, attach, or otherwise mount console 10 in its desired lateral position relative to the checkout stand. One common position is to mount console 10 so that top 12 is above or close to the scanning zone, preferably, aligned with the bar code scanner. Typically, the scanning zone is positioned between the cashier and the customer on the checkout stand; the bar code scanner is typically positioned within a recess in the counter or cabinet.

In the embodiment illustrated, stand support structure 14 includes a bracket 32 for mounting console 10 to a vertical surface, such as a counter sidewall. It is understood that console 10 could be mounted on various other vertical surfaces, or on a horizontal surface, such as a counter top, internal counter bottom, or even on the floor. It is understood that the desired mounting surface will impact the length of stand support structure 14 or the position of bracket 32. The specific design, configuration, or manufacturer of the counter or cabinet does not affect the overall design and installation mechanism of console 10.

Top support structure 16 provides direct support for top 12. Top support structure 16 has two portions, fixed support portion 18 and bracket portion 24. Fixed support portion 18 is fixed to top 12, and bracket portion 24 is movably attached to support portion 18 and thus to top 12, as will be described in further detail below. In the embodiment illustrated, fixed support portion 18 includes a volume 19 for receiving a cash drawer. Fixed support portion 18 generally includes apertures aligned with any apertures in top 12.

Volume 19 for receiving a cash drawer is particularly useful in providing a convenient working environment for the cashier. By positioning the cash drawer in front of the cashier when the cashier is facing the customer, twisting and turning by the cashier is minimized; the cashier will no longer have to turn to get money to or from the cash drawer after scanning, and will not have to turn back to the customer. All transactions can be performed at console 10. This minimization of repeated twisting and turning is beneficial to the health of the cashier. Additionally, with the cash drawer placed in front of the cashier, rather than at a side location, security issues related to an open drawer are reduced. In most instances, a decrease in checkout time will be realized, due the elimination of several seconds needed to turn to and access a remote cash drawer.

Returning to the Figures, together, top support structure 16 and stand support structure 14 provide console 10 with vertically adjustable features. These features allow top 12 to be raised or lowered, on demand, without having to remove console 10 from its position of mounting. After being raised or lowered, as desired, the stand can be returned to its initial position or to yet another position. This is especially useful when performing maintenance on the bar code scanner or other equipment that is part of the checkout assembly.

In the particular embodiments illustrated, bracket 24, which, when console 10 is mounted in its desired position, is securely mounted, attached or otherwise fixed to a structure such as a counter sidewall, for example, with four screws. Likewise, bracket 32 is securely mounted or otherwise fixed to a structure. This structure may be the same or a different structure to which bracket 24 is attached. Whether the same structure is used or not, bracket 24 is fixed in relation to bracket 32. It is bracket 24 and bracket 32 that provide the lateral positioning of console 10 and are the basis for the vertical position of console 10. That is, console 10 is not movable laterally without unattaching or unmounting bracket 24 and bracket 32, but top 12 of console 10 is vertically movable. Further details of the vertical movement are provided below.

In the embodiment illustrated, stand support structure 14 comprises a leg 15. Present on leg 15 is a biasing element, such as compression spring 20, and a lock ring 21. Lock ring 21 may be permanently attached to or repositionable along leg 15. Spring 20 has a first end 20*a* and a second opposite end 20*b*, each of which is not secured or fixedly attached to leg 15 and is thus movable in relation to leg 15. When spring 20 is compressed, first end 20*a* abuts lock ring 21. Bracket 32 is fixed to spring 20 in close proximity to second end 20*b* and thus, bracket 32 is also movable in relation to leg 15. It is understood that other mechanisms other than ring 21 or bracket 32 can be used to attach spring 20 to leg 15. Similarly, other biasing elements other than spring 20 can be used to raise top 12, for example, a piston may be used. Additionally, bracket 32 can be attached to spring 20 at a position other than end 20*b*, or, in some designs, spring 20 may merely abut bracket 32 rather than be attached thereto.

Figure 3:
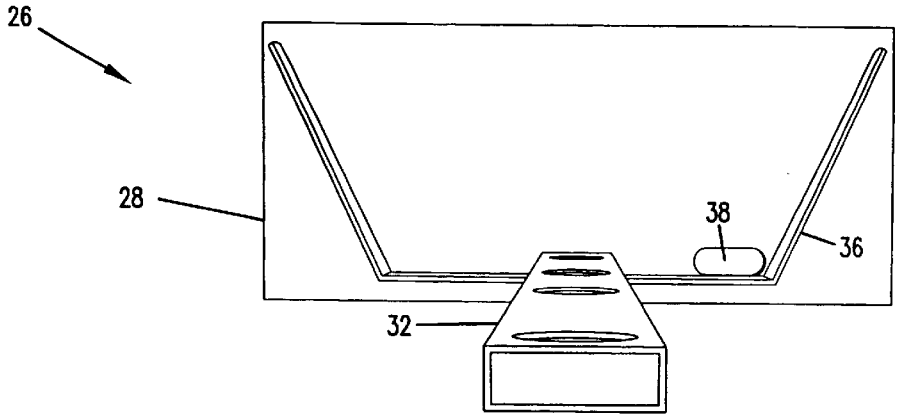
FIG. 3 is a side plan view of the console of FIG. 1.
Figure 5:
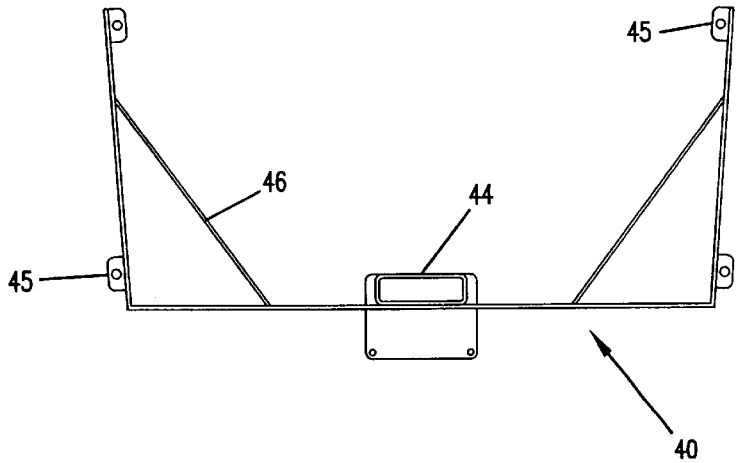
FIG. 5 is a top perspective view of a fixed support portion of a top support structure of the console of FIG. 1.
Figure 4:
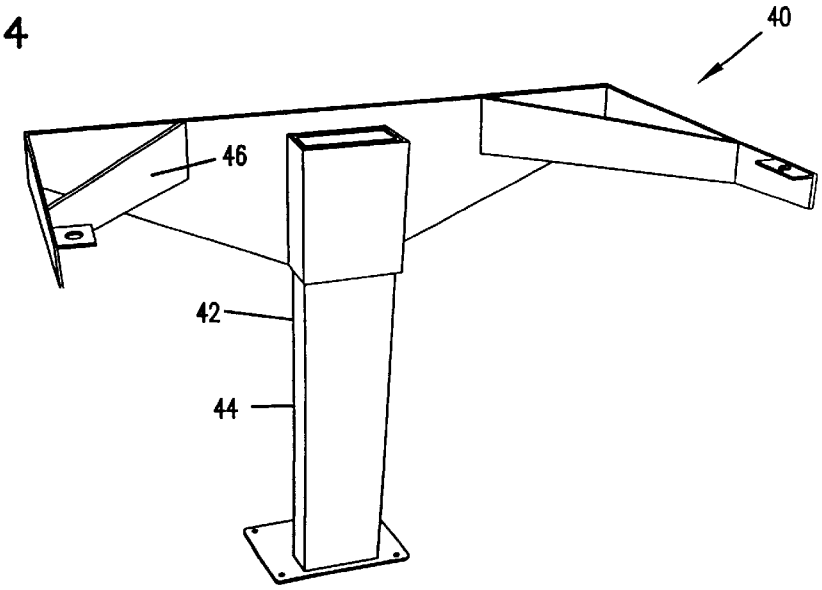
FIG. 4 is a front plan view of the console of FIG. 1.
Figure 6:
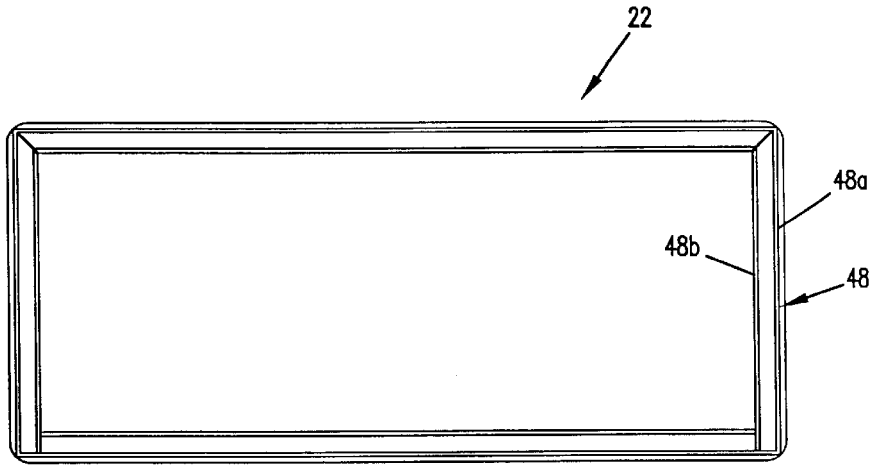
FIG. 6 is a perspective view of a bracket of a top support structure of the console of FIG. 1.
Figure 7:
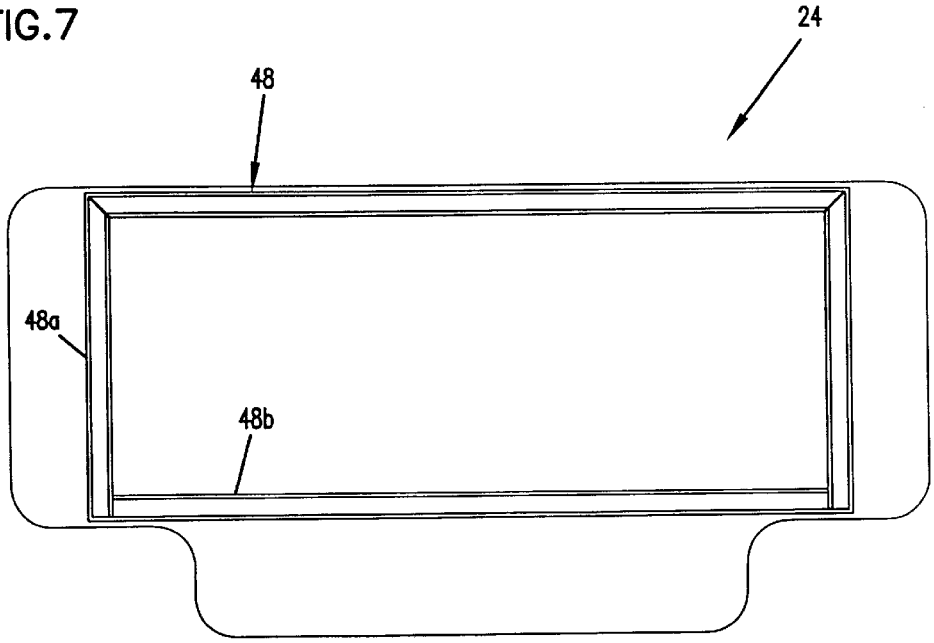
Figure 8:
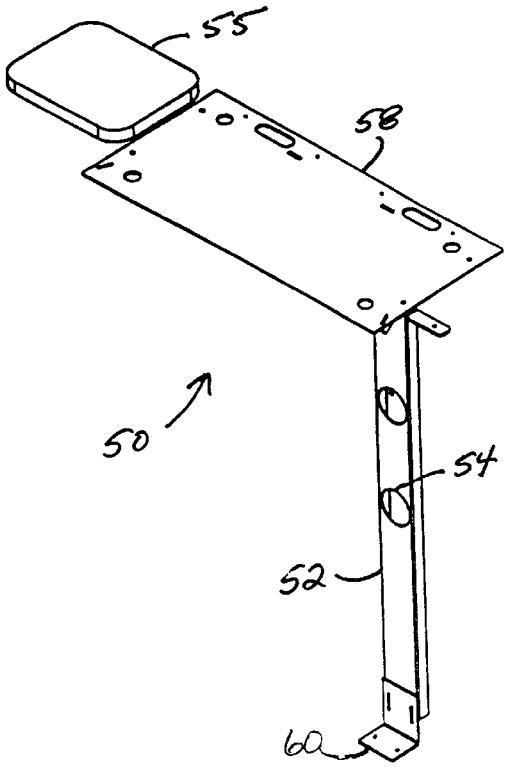
Figure 9:
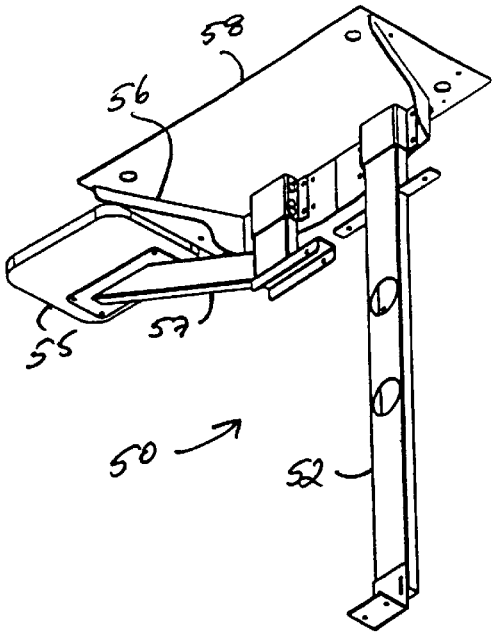
Figure 10:
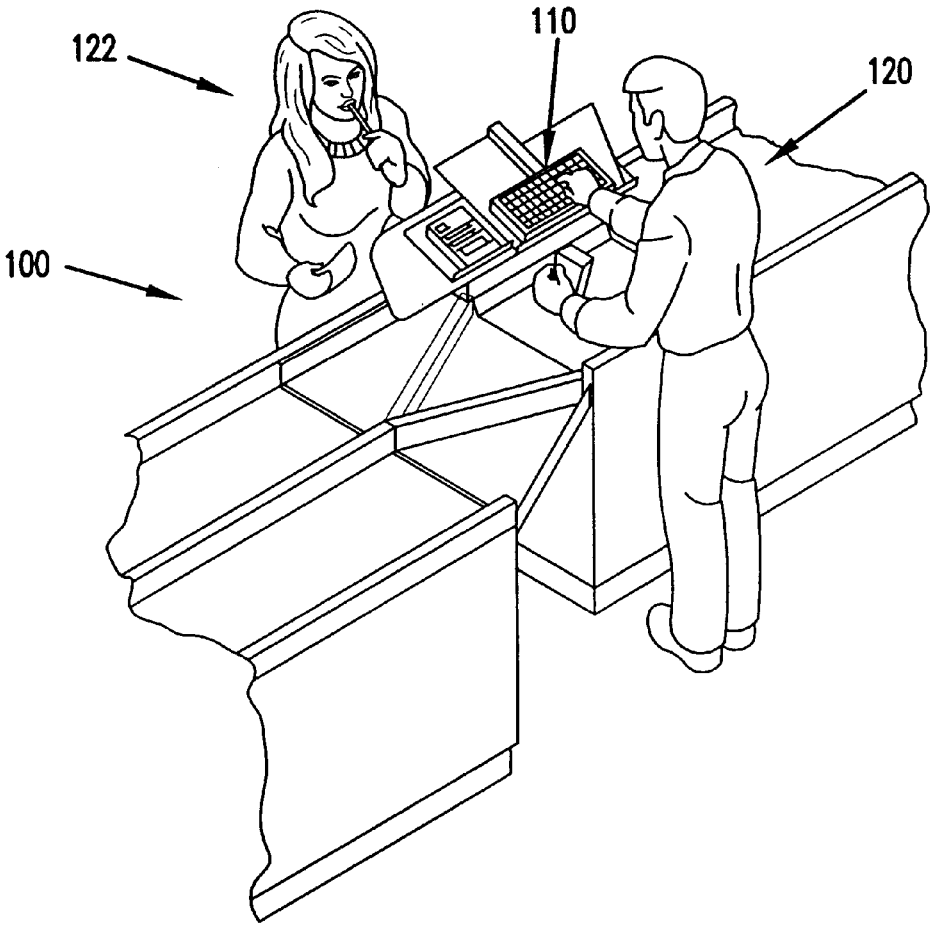
Figure 1:
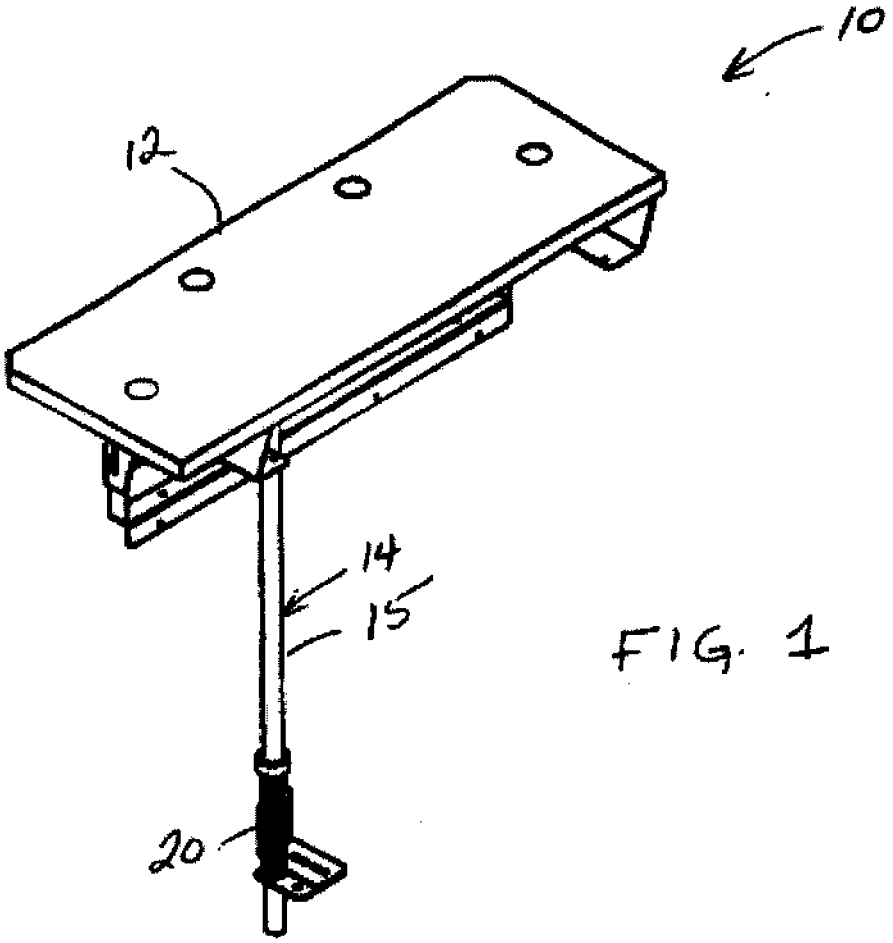
Figure 2:
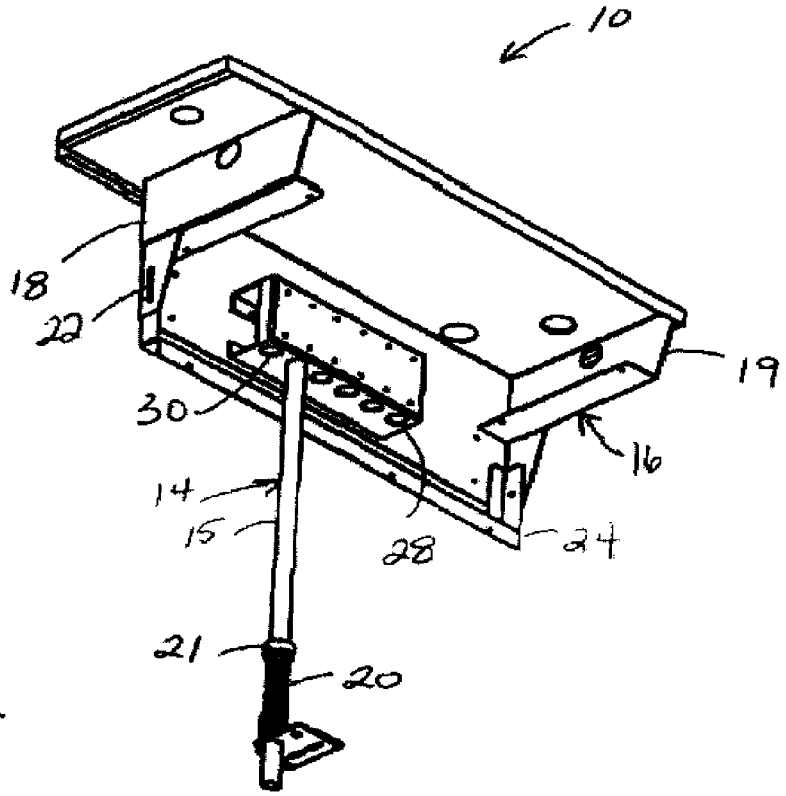
Figure 3:
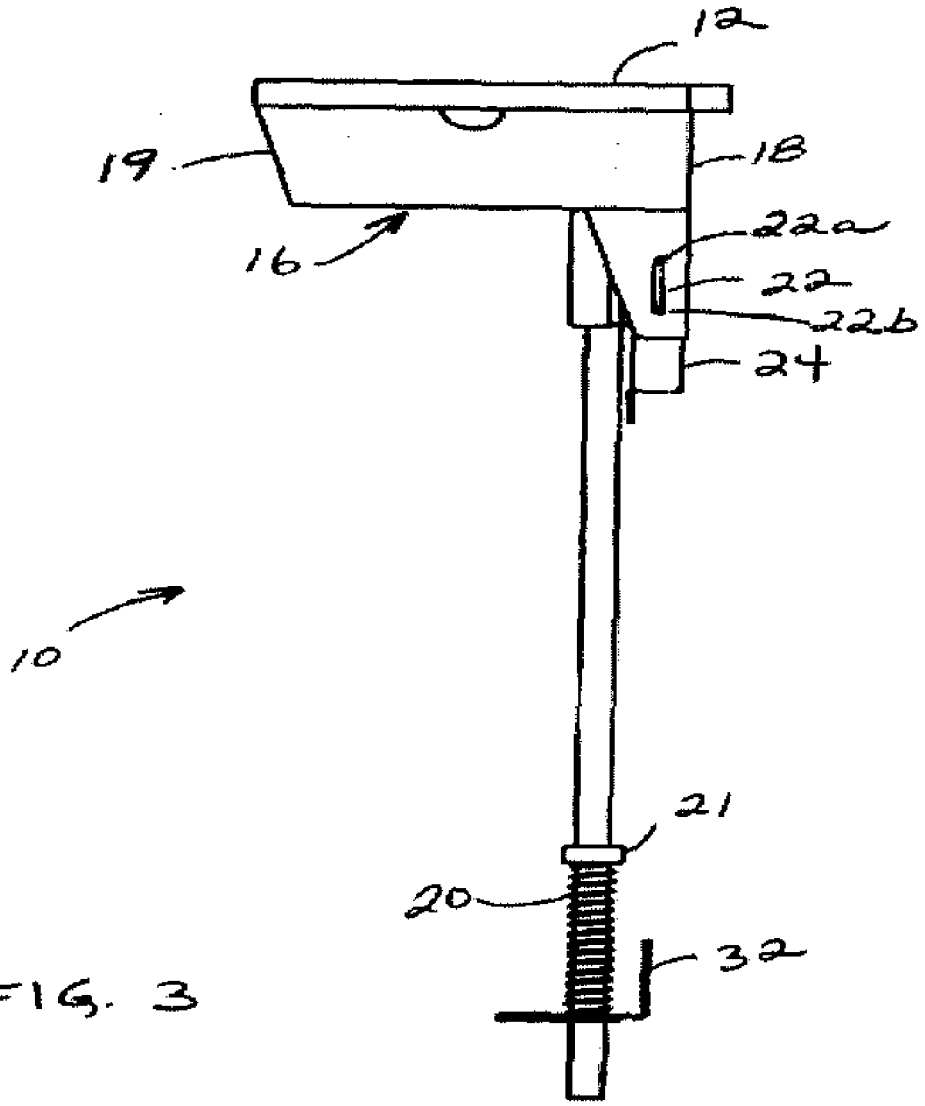
Figure 4:
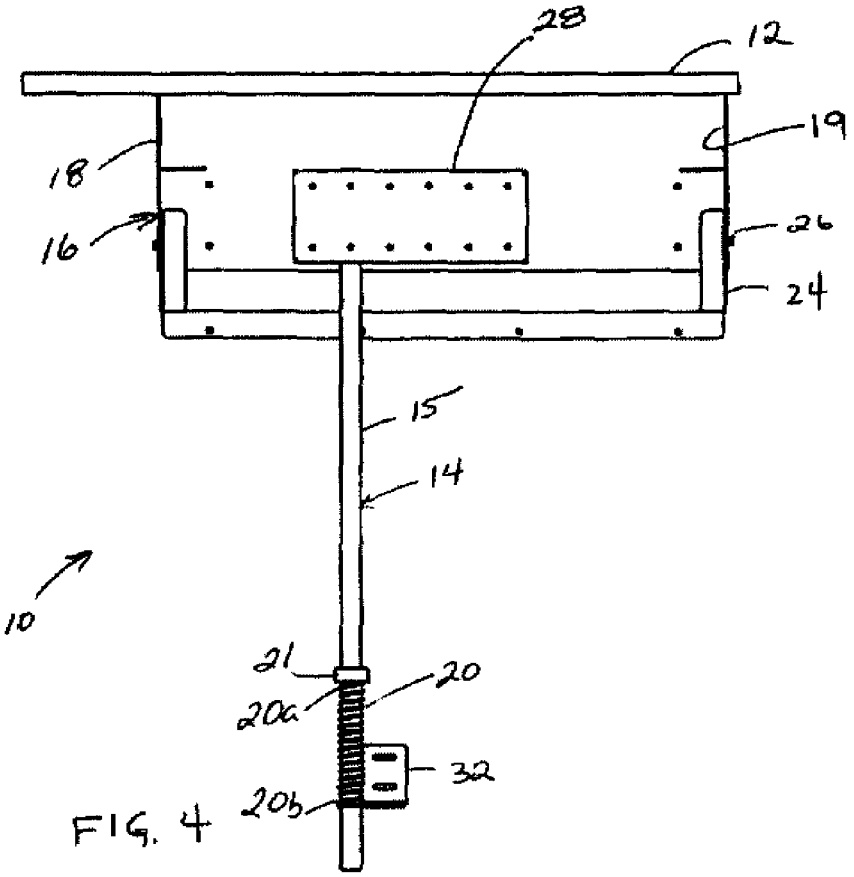
Figure 5:
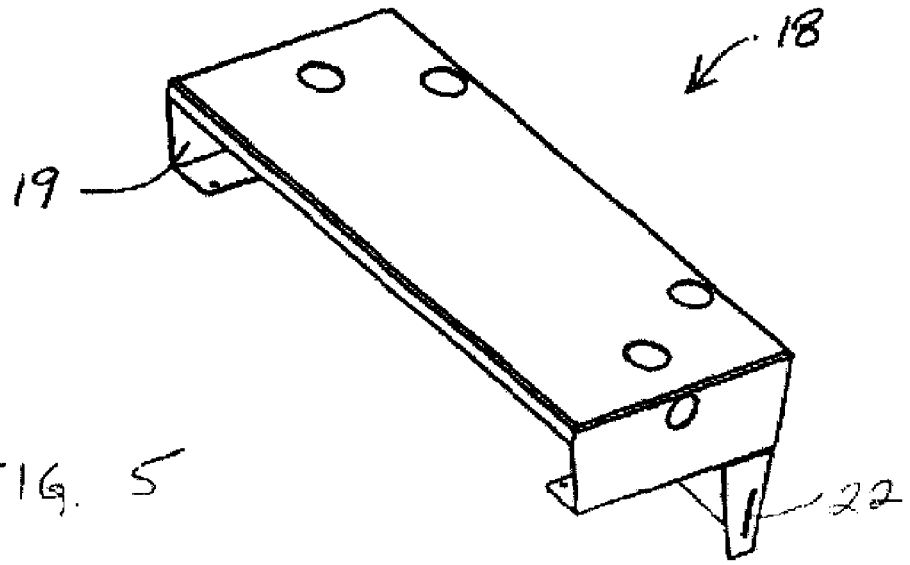
Figure 6:
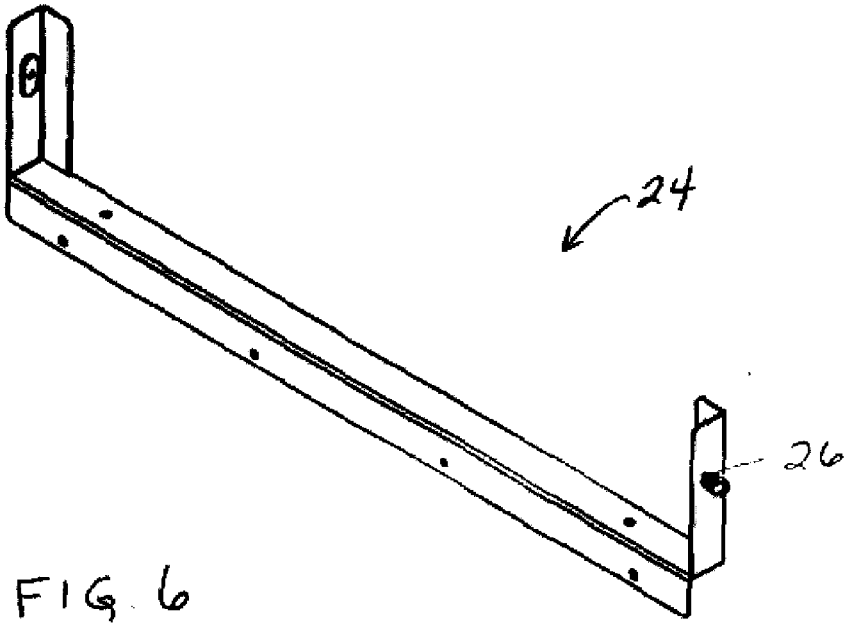

Returning again to top support structure 16, the two portions, fixed support portion 18 and bracket 24 are shown in FIGS. 5 and 6, respectively. As stated above, bracket 24 is movably attached to fixed support portion 18. As best seen in FIGS. 3 and 5, fixed support portion 18 has a slot 22 therein; preferably each end of portion 18 has a slot 22 therein. Slot 22 extends vertically, but in some instances, may be slanted; the amount of angle to the slant will affect the vertical distance top 12 can be raised. Slot 22 has a first end 22*a*, positioned farther from spring 20 than an opposite second end 22*b*. Bracket 24, best seen in FIGS. 3 and 6, has a bolt 26, which is an element shaped and sized to be received into and movable in slot 22. Bolt 26 is moveable within slot 22, preferably the entire length of slot 22 from end 22*a* to end 22*b*. A nut (not shown) or other engagement piece can be used to secure bolt 26 in relation to slot 22. When bolt 26 is engaged and movable within slot 22, bracket 24 is movable in relation to fixed support portion 18. Bolt 26 may be permanently affixed to bracket 24.

It is understood that in alternate configurations, bracket 24 could have a slot therein and fixed support portion 18 could have an element such as bolt 26 for movable engagement with the slot. In yet a further alternate configuration, bracket 24 could include a bolt-acceptance element instead of bolt 26; that is, bracket 24 could include a nut for receiving a bolt, and bolt 26 would be passable through slot 22.

Further, although bolt 26 and nut have been disclosed, it is understood that any type of suitable fastener, such as a screw, nail, pin, or other type of fastener can be used to fix bracket 24 in the desired position in relation to fixed support portion 18, and thus fix the height of top 12.

In operation, console 10 is installed, for example on a vertical surface such as a counter sidewall, by attaching (e.g., bolting) each of bracket 32 and bracket 24 to the surface. Brackets 24 and 32 should be attached so that when spring 20 is relaxed, preferably fully or nearly fully extended, bolt 26 is at end 22*b* of slot 22.

This position, having spring 20 uncompressed and bolt 26 positioned at end 22*b*, is referred to a "raised position". In order to move console 10 to a "depressed" or "lowered" position, spring 20 is compressed, typically by manual pressure on top 12, and bolt 26 is moved to end 22*a*. When in the depressed position, console 10 should not be so tall or high that the average customer and average cashier find it awkward or inconvenient to exchange currency, receive a check, or otherwise consummate the sale over top 12. Conversely when in the depressed position, console 10 should not be so low that equipment such as a scanner cannot be positioned below. "Partially raised" or "partially depressed" positions are possible, where bolt 26 is positioned between end 22*a* and 22*b*. As mentioned, a nut, screw, or other type of fastener can be used to fix bolt 26 in the desired position, and thus fix top 12.

Typically during use, when installed at a checkout stand, console 10 is in a depressed position, preferably in a depressed-most position, with spring 20 compressed and bolt 26 located at end 22*a*. Console 10 is preferably positioned over the bar code scanner, with minimum clearance (for example, less than 1 inch) between console 10 and the scanner. Top 12 of console 10 generally extends no more than about 1 inch past the scanner into the product pathway.

To move top 12 to a raised position, the nut, screw, or other fastener retaining bolt 26 at end 22*a*, is released, allowing spring 20 to expand and bolt 26 to slide within slot 22 to the opposite end 22*b*. Top 12 and support portion 18 would be typically raised when additional clearance is needed under support structure 14, for example, when servicing the bar code scanner positioned under console 10.

The vertical travel of top 12 is generally a function of the length of slot 22. In addition, spring 20 can affect the amount of raising and lowering available to top 12. If more vertical travel is desired for top 12, a longer slot 22 can be provided. It is preferred to have at least 2 inches of vertical travel for top 12, although any other distances, such as 3 inches, 4 inches, etc., are suitable.

In the embodiment illustrated, fixed portion 18 of top support structure 16 includes a mounting saddle 28, which attaches fixed portion 18 to leg 15. Saddle 28 supports the weight of top 12, plus the cash drawer, its contents, and any other equipment; saddle 28 is constructed to transfer force from console top 12 to leg 15 and mounting bracket 32. Saddle 28 further allows for lateral repositioning of top 12 and top support structure 16, including bracket 24, after bracket 32 has been attached to a surface. Saddle 28 includes multiple apertures 30, which are shaped and sized to accommodate leg 15. Leg 15 can be easily moved, as desired, among apertures 30.

Console 10 is sufficiently rigid and substantial in size to adequately accommodate any foreseen uses. For example, console 10 is designed to retain a cash drawer and thus console 10 is sufficiently rigid and sturdy to accept the high level or activity of the opening and closing of the cash drawer. All of top 12, top support structure 16 and stand support structure 14 should be sufficiently rigid and strong to adequately support the structure, any peripheral equipment, and any extra weight that may be placed on top 12, such as a heavy purse or a customer leaning on the top. Top 12 can be any material, such as metal (aluminum, steel, iron), polymeric material, ceramic, composite, wood or any other suitable material. Similarly, support structures 14, 16 can be any material, such as metal (aluminum, steel, iron), polymeric material, ceramic, composite, wood, or any other suitable material, however typically, support structures 14, 16 will be metal. It is foreseen that in some constructions, different materials may be used for top 12, stand support structure 14, fixed support portion 18 and/or bracket 24. In one embodiment, the entire structure of console 10, except for top 12, is made from steel, and top 12 is stainless steel. Typical and well known manufacturing techniques can be used for manufacturing console 10. The technique used will depend on the material used for the various parts of console 10.

In one particular configuration for the embodiment shown, leg 15 is a 0.875 inch diameter, circular tube with a 0.125 inch thick wall, approximately 34 inches long. Wires or cables, for peripheral equipment positioned on console 10, may pass through the interior of leg 15. Ring 21 is positioned about 12 inches from the end of leg 15, but will vary with the specific installation of console 10. Spring 20 is a coiled spring about 6 to 8 inches long, when uncompressed, and can be compressed at least 2 inches.

Fixed support portion 18 is approximately 25.3 inches by 11 inches on its top surface. The overall height of support portion 18 is about 9.5 inches. Volume 19 for a cash drawer is approximately 4.625 inches tall, 11 inches deep, and about 25.3 inches wide. The front face of volume 19 is slightly angled back. Slot 22 is approximately 2 inches long and 0.26 inch wide. Bracket 24 is sized to fit internal to fixed support portion 18, and is about 25.1 inches long.

It is understood that any variety of dimensions can be used for the features of console 10, and that the dimensions provided above are merely exemplary of one embodiment.

The above specification, examples and data provide a complete description of the manufacture and use of the structure of the invention. Since many embodiments of the invention can be made without departing from the spirit and scope of the invention, the invention resides in the claims hereinafter appended.

What is claimed:

1. A store checkout console for attaching to a checkout surface, the console comprising:

(a) a stand support structure, the stand support structure comprising:
  (i) a leg;
  (ii) a mounting portion fixed to and movable in respect to the leg, the mounting portion configured for fixed attachment to the checkout surface; and
  (iii) a biasing element connected to the leg and to the mounting portion; and (b) a top support structure attached to the leg of the stand support structure, the top support structure comprising:
  (i) a first portion; and
  (ii) a second portion, the second portion movably attached to the first portion and configured for fixed attachment to the checkout surface.

2. The console according to claim 1, the top support structure further comprising a volume for receiving a cash drawer therein.

3. The console according to claim 1, wherein the biasing element is a spring.

4. The console according to claim 3, wherein the biasing element is a coil spring.

5. The console according to claim 1, wherein:

(a) the first portion includes at least one slot therein, the slot having a vertical vector; and (b) the second portion comprises an element for engaging the slot.

6. The console according to claim 5, wherein the element for engaging the slot is a pin.

7. The console according to claim 5, wherein the element for engaging the slot is a bolt.

8. The console according to claim 5, wherein the slot has a length of about 2 inches.

9. The console according to claim 1, further comprising a top attached to the first portion of the top support structure.

10. A checkout console for attachment to a surface, the console comprising:

(a) a stand support structure comprising:
  (i) a first supporting structure configured for fixed attachment to the surface;
  (ii) a second supporting structure attached to the first supporting structure and movable in respect to the first supporting structure; and
  (iii) a biasing element attached to the first supporting structure and the second supporting structure;

(b) a top; and (c) a top support structure attached to the stand support and to the top, the top support structure comprising:
  (i) a first portion fixedly attached to the top; and
  (ii) a second portion configured for fixed attachment to the surface, and movably attached to the first portion.

11. The console according to claim 10, the top support structure further comprising a volume for receiving a cash drawer therein.

12. The console according to claim 10, wherein the biasing element is a spring.

13. The console according to claim 10, wherein the second supporting structure is a leg, and the first supporting structure is a bracket.

14. The console according to claim 10, wherein:

(a) the first portion includes at least one slot therein, the slot having a vertical vector; and (b) the second portion comprises an element for engaging the slot.

15. The console according to claim 14, wherein the element for engaging the slot is a bolt.

16. The console according to claim 14, wherein the element for engaging the slot is a pin.

17. A method of moving a top of a checkout console in a vertical direction, the checkout console comprising a stand support structure connected to a top support structure, the stand support structure comprising a leg portion and a mounting portion movably attached together, and the top support structure comprising a first portion and a second portion movably attached together and retained by a fastening element, the method comprising:

(a) disengaging the fastening element on the top support structure;

(b) moving the first portion of the top support structure in respect to the second portion of the top support structure; and, (c) moving the leg portion of the stand support structure in respect to the mounting portion of the stand support structure.

18. The method according to claim 17, wherein the steps of moving the first portion of the top support structure in respect to the second portion of the top support structure and moving the leg portion of the stand support structure in respect to the mounting portion of the stand support structure are done simultaneously.

19. The method according to claim 18, wherein the step of moving the leg portion of the stand support structure in respect to the mounting portion of the stand support structure comprises releasing a spring to move the leg portion of the stand support structure in respect to the mounting portion of the stand support structure.

20. The console according to claim 1, wherein:

(a) the second portion includes at least one slot therein, the slot having a vertical vector; and (b) the first portion comprises an element for engaging the slot.

* * * * *

UNITED STATES PATENT AND TRADEMARK OFFICE

CERTIFICATE OF CORRECTION

PATENT NO. : 6,729,242 B2
DATED : May 4, 2004
INVENTOR(S) : Kerber

It is certified that error appears in the above-identified patent and that said Letters Patent is hereby corrected as shown below:

Drawings,
Please delete erroneous Figures 1-10 (Sheets 1-5), and replace with the attached correct Figures 1-6.

Signed and Sealed this

Twenty-first Day of December, 2004

JON W. DUDAS
*Director of the United States Patent and Trademark Office*